United States Patent [19]

Masillo

[11] 4,418,274

[45] Nov. 29, 1983

[54] SLIDE RULE - CALENDAR

[76] Inventor: Guido Masillo, Via Lanzalone, 26, 84100 Salerno, Italy

[21] Appl. No.: 245,783

[22] Filed: Mar. 20, 1981

[30] Foreign Application Priority Data

Mar. 24, 1980 [IT] Italy ..... 35659/80[U]

[51] Int. Cl.[3] ..... G06C 3/00; G09D 3/10

[52] U.S. Cl. ..... 235/85 R; 40/109

[58] Field of Search ..... 235/69–70 D, 235/89 R, 116, 85 R–88 RC; 40/107, 109

[56] References Cited

U.S. PATENT DOCUMENTS 1,810,153 6/1931 Aken ..... 235/116
2,530,047 11/1950 Dewar ..... 235/70 R
3,201,884 8/1965 Aughey ..... 40/109

FOREIGN PATENT DOCUMENTS 1027507 5/1953 France .
1092504 4/1955 France .
1164908 10/1958 France .
2166818 8/1973 France .

*Primary Examiner*—Benjamin R. Fuller
*Attorney, Agent, or Firm*—Beveridge, DeGrandi & Kline

[57] ABSTRACT

A slide rule-calendar having a fixed part, two sliding parts and a cursor. On the lower portion of the fixed part, the thirty-one days of the longest month are indicated horizontally. The twelve months of the year are indicated on the left vertical portion of the fixed part and also on the cursor.

By positioning the two sliding parts on predetermined parameters shown on the top and bottom left portion of the fixed part which parameters correspond as a pair to a series of equivalent years and by moving the cursor to the desired day, all the days of the week of the equivalent past and future years corresponding to said pair of parameters can be determined, with only one positioning of the two sliding parts.

1 Claim, 5 Drawing Figures

| 1600 e 2000 | 1700 e 2100 | 1800 e 2200 | 1900 e 2300 | YEARS | | | |
|---|---|---|---|---|---|---|---|
| 5·6 | 4·4 | 2·2 | 7·7 | 0 | | | |
| 5·6 | 3·4 | 1·2 | 6·7 | | 28 | 56 | 84 |
| 7·7 | 5·5 | 3·3 | 1·1 | 1 | 29 | 57 | 85 |
| 1·1 | 6·6 | 4·4 | 2·2 | 2 | 30 | 58 | 86 |
| 2·2 | 7·7 | 5·5 | 3·3 | 3 | 31 | 59 | 87 |
| 3·4 | 1·2 | 6·7 | 4·5 | 4 | 32 | 60 | 88 |
| 5·5 | 3·3 | 1·1 | 6·6 | 5 | 33 | 61 | 89 |
| 6·6 | 4·4 | 2·2 | 7·7 | 6 | 34 | 62 | 90 |
| 7·7 | 5·5 | 3·3 | 1·1 | 7 | 35 | 63 | 91 |
| 1·2 | 6·7 | 4·5 | 2·3 | 8 | 36 | 64 | 92 |
| 3·3 | 1·1 | 6·6 | 4·4 | 9 | 37 | 65 | 93 |
| 4·4 | 2·2 | 7·7 | 5·5 | 10 | 38 | 66 | 94 |
| 5·5 | 3·3 | 1·1 | 6·6 | 11 | 39 | 67 | 95 |
| 6·7 | 4·5 | 2·3 | 7·1 | 12 | 40 | 68 | 96 |
| 1·1 | 6·6 | 4·4 | 2·2 | 13 | 41 | 69 | 97 |
| 2·2 | 7·7 | 5·5 | 3·3 | 14 | 42 | 70 | 98 |
| 3·3 | 1·1 | 6·6 | 4·4 | 15 | 43 | 71 | 99 |
| 4·5 | 2·3 | 7·1 | 5·6 | 16 | 44 | 72 | |
| 6·6 | 4·4 | 2·2 | 7·7 | 17 | 45 | 73 | |
| 7·7 | 5·5 | 3·3 | 1·1 | 18 | 46 | 74 | |
| 1·1 | 6·6 | 4·4 | 2·2 | 19 | 47 | 75 | |
| 2·3 | 7·1 | 5·6 | 3·4 | 20 | 48 | 76 | |
| 4·4 | 2·2 | 7·7 | 5·5 | 21 | 49 | 77 | |
| 5·5 | 3·3 | 1·1 | 6·6 | 22 | 50 | 78 | |
| 6·6 | 4·4 | 2·2 | 7·7 | 23 | 51 | 79 | |
| 7·1 | 5·6 | 3·4 | 1·2 | 24 | 52 | 80 | |
| 2·2 | 7·7 | 5·5 | 3·3 | 25 | 53 | 81 | |
| 3·3 | 1·1 | 6·6 | 4·4 | 26 | 54 | 82 | |
| 4·4 | 2·2 | 7·7 | 5·5 | 27 | 55 | 83 | |

SLIDE RULE - CALENDAR

This invention concerns a slide rule-calendar capable of indicating the day of the week corresponding to the solar day in any month of any year over a time period defined by the predetermined extremes of the Gregorian calendar. The result applies to the year considered as well as to all the other equivalent years past and future.

The need to rapidly determine, simply and accurately, the day on which a past or future date occurs in many areas of business, industry, banking, jurisprudence, investigation, history, etc. This requirement is particularly important in the field of historical research.

Currently, this information may be obtained from appropriate tables (generally, three tables to be placed in reciprocal correlation) or from a rotating disk. However, these methods do not satisfy the requirements of practicality, speed, and completeness of information, which are often all needed. In fact, both the tables and the disks give data for at the most only one month of the year under consideration. The tables give only the day of the year; the disks or other systems give at the most only one month.

The aim of this invention is thus to provide an instrument which, rapidly positioned, allows one to immediately and simultaneously determine any day of the week in any month in any year within a time period defined by the predetermined extremes of the Gregorian calendar. This determination would be valid both for the year considered as well as for all the other equivalent years past and future.

The invention achieves this goal with an instrument similar to a normal calculating slide rule, comprising essentially a fixed part in the shape of a flat sheath closed at the end, on the inside of which there are two sliding parts, equal in length to the fixed part but of different heights, which slide up against the bottom of the sheath-like fixed part. There is also a transparent cursor mounted on the fixed sheath-like part which can slide all along its length.

The fundamental concept of the invention lies in the observation that in the calendar the days of the week repeat in a constant fashion, with respect to the corresponding solar days, with a recurring frequency equal to a constant number of centuries and years.

According to the invention, along the lower edge of the front of the sheath-like fixed part are set out in progressive order along its length all the days of the month. Along the height of this fixed part, vertically in the area near the left edge, the names of the months of the year are shown divided into two parts. One of these includes the leap year month, which acts as compensation for the annual losses reabsorbed with constant frequency.

According to this invention, each of the two parts of this area has corresponding to it a sliding part, and the two sliding parts are independent of each other. The days of the week are set out, starting on the first sliding part and proceeding to the second. More specifically, these run along a number of horizontal lines arranged so as to correspond to the months of the year set out vertically adjacent the sliding parts. In order to fix a reference point for basing and calibrating the instrument, any non-leap year is selected immediately following a leap year. Corresponding to the days of each month shown along the bottom of the fixed part of the slide rule, the respective first letters of the corresponding days of the week are given along each horizontal line. In this way, the last place on each horizontal line corresponds to the last week day of each month, and the first place of the subsequent horizontal line corresponds to the first week day of the subsequent month. The transparent cursor mounted on the fixed part and sliding along its entire length is also equipped with marks for the months of the year along a vertical line in correspondence with marks for the months shown on the fixed part. Moreover, the cursor has three vertical parallel windows which show in vertical succession the days of the week relative to three consecutive days of all the months of the year as well as on a horizontal line three consecutive days of each month of the year. By sliding the cursor along the fixed part of the slide rule, from the first to the last day of each month, one can immediately determine in correspondence to the mark for each month the respective days of the week for the entire calendar period included within the year taken as reference point for basing and calibrating the instrument. As already mentioned, this information will be valid for all the equivalent past and future years.

To go to the next year, the upper sliding part is slid to the left so as to display over the solar day of the first month of the year, the week day following that corresponding to the last solar day of the last month of the year. It should be noted at this point that, as is well known, for the non-leap years, the last week day of the last month of the year is the same as the first week day of the first week of the year. Since the new year to be considered is not a leap year, if the twenty-eighth week day of the leap year month (February) is shown and the lower sliding part of the slide rule is shifted to the left, the week day following that corresponding to the last day of the previous month is displayed over the day of the next month (March). In this case as well, it should be noted that the first week day of the first month of the year corresponds to the last week day of the last month. The operation is repeated in the same way for a subsequent, non-leap year. In placing the third year after the initial reference year, it must be considered that this is a leap year. Therefore, after the week day following the last week day of the last month has been set over the first solar day of the first month of the year with the upper sliding part of the slide rule, the twenty-ninth week day of the leap year month (February) must be considered when the lower sliding part of the slide rule is shifted to the left. In this way, the week day following that corresponding to the twenty-ninth day of the preceding bissextile month is displayed over the first solar day of the following month (March). At this point, it will be noted that the last week day of the last month of the year no longer corresponds to the first week day of the first month. Rather, the first week day of the first month of the year will correspond to the week day following the latter, that is, the second week day following the first week day of two years before. Proceeding with the calibration operation, it will be noted that the two sliding parts must be shifted to the left, beyond the fixed sheath-like part of the slide rule, for a period of six consecutive years encompassing that taken as the reference or starting point, before these same equivalent positions are repeated, considering that a leap year is included in this period. In this case, the two sliding parts can be returned to the right, to the point where they touch the inside of the sheath, that is, to the initial position. This means that in calibrating the instrument, one takes as reference any non-leap year immediately following a leap one. The operation is repeated year by year as described above, always considering the leap year included in this period, for six times before one returns to the exact starting position. At this point, after these six operations, when the slide rule-calendar based on the calibration so performed is used, it may be noted that to return to the original starting point, one continues the operations for another eleven consecutive years, always staying within the extreme limits for the linear shifts determined above. This means that for normal use of the slide rule-calendar, the two upper and lower sliding parts must be shifted as a function of seven parameters which are equal in number to the days of the week. Each pair of these refers to a leap year if the parameters are different and to a non-leap year if they are the same.

Upon establishing the reference year as described above and going on to the subsequent years for the calibration, it may be noted that the indications for additional week days are missing on the right side of the sliding parts. There must therefore be added to each horizontal line in correspondence with each month of the year. More precisely, this means six week days for thirty-one day months, seven week days for thirty day months, and seven week days for the leap year month (February), from the point where this leap year month has two fewer days than the longest months.

According to the invention, the upper and lower areas on the left of the fixed sheath-like part of the slide rule-calendar each have a small window within which the seven parameters described above are shown, marked with letters or numbers. These marks are arranged so that each upper mark corresponds to the same lower one. Corresponding to each upper mark there is an arrow facing down, and corresponding to each lower mark there is an arrow facing up. These arrows are made to coincide with an oppositely-pointing arrow on the upper and lower sliding parts when a reading is taken. In this way, a pair of such parameters is used to determine and represent the reciprocal position of the sliding parts corresponding to a solar year and, simultaneously, to an equivalent past or future solar year. Furthermore, this allows an informative table to be prepared, which is shown on the back of the fixed part of the slide rule. In four vertical columns, the pairs of parameters are indicated, each related to a two centuries. Next to them, on each of a series of horizongal lines are shown three or four years, equivalent to calendar years, corresponding to the same position of the sliding parts with respect to these same parameters.

Therefore, the desired year of the desired century is selected on the back of the sheath-like fixed part of the slide rule, and the pair of parameters is read in horizontal correspondence. The sliding parts of the slide rule must then be positioned on this pair. By using the transparent cursor, the respective week day can be determined corresponding to each solar day by making an indicator at the bottom of the central window coincide with the preselected day on the fixed part. Obviously, this reading gives information valid for the selected year and for the equivalent past and future years reported on the table in correspondence to the same pair of parameters.

As shown by the above description, the advantages offered by this invention consist of the possibility of simply and rapidly determining the week day of any month of any Gregorian calendar year included within the pre-established limits. This result is valid simultaneously for the entire year as well as for all the equivalent past and future years. Another advantage is that all this information can be obtained with one single placement of the two sliding parts of the instrument with respect to the fixed sheath-like part, simply by shifting the transparent cursor to find the desired day.

The object of the invention will be illustrated below with reference to a preferred actuation exemplified in a non-limiting sense in the attached drawings. The figures are as described below.

Figure 1:
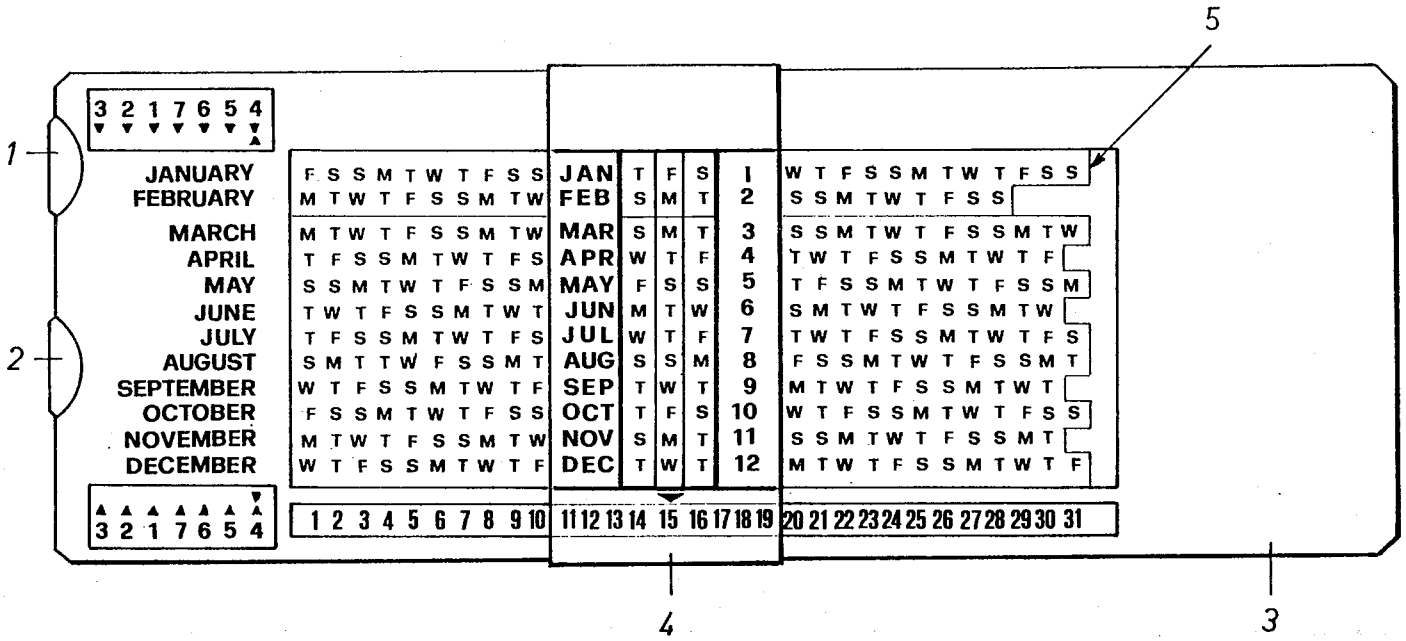
FIG. 1 is a front plan view of the slide rule-calendar according to the invention set to the 15th day of the year 1582.

FIG. 1 shows the slide rule-calendar according to the invention in a calibration position selected, in the present case, to coincide with the year 1909, the 15th day of October. This day is equivalent to that on which the Gregorian calendar became effective (Oct. 15, 1582, see Encyclopedia Brittanica). As shown, the sliding parts 1 and 2 are at the end, that is, up against the bottom of the sheath-like fixed part 3, on the left side of which the months of the year are indicated. The transparent cursor 4 is positioned so that the indicator arrow beneath its central vertical window corresponds to the 15th solar day, and corresponding to the month of October that day is shown to be a Friday. Also, the year is not a leap year, since it begins and ends with the same week day (Friday). In the upper and lower areas on the left side of the sheath-like fixed part, the following parameters are arranged, in this case from right to left: 4, 5, 6, 7, 1, 2, 3. These parameters may be indicated with letters or other marks, always numbering seven for the reasons set out below. The upper and lower sliding parts are positioned on the pair of parameters 4,4 (see the oppositely directed arrows). Shifting the cursor 4 from the first to the last solar day, reported on the lower part of the fixed sheath, one can immediately determine the week days for each month of the year 1909. The same reading will be valid at the same time for all the years corresponding to position 4,4 of the sliding parts, namely:

| Centuries | Years (non-leap year) |
|---|---|
| 1500/1900 | 09 = 37 = 65 = 93 |
| | 15 = 43 = 71 = 99 |
| | 26 = 54 = 82 |
| 1600/2000 | 10 = 38 = 66 = 94 |
| | 21 = 49 = 77 |
| | 27 = 55 = 83 |
| 1700/2100 | 00 = 06 = 34 = 62 = 90 |
| | 17 = 45 = 73 |
| | 23 = 51 = 79 |
| 1800/2200 | 02 = 30 = 58 = 86 |
| | 13 = 41 = 69 = 97 |
| | 19 = 47 = 75 |

On the right of the upper and lower sliding parts, from the top to the bottom runs a dashed line 5, shown in FIG. 1, which fixes on the left the limit of the week days of the year 1909 (=1582). This year was taken as the reference for calibrating the instrument since it is a non-leap year immediately following a leap one. Starting from this dashed line 5, going toward the right, on each horizontal line are reported the additional week days necessary for the instrument to function as the sliding parts are moved to the left. As already mentioned, there are six added for months with thirty-one days, and seven for months with thirty days and February. These are only partially visible in FIGS. 2, 3 and 4.

As explained above, for the calibration, starting for example from the year 1909 (=1582, FIG. 1) which ends with Friday, the sliding part 1 is moved to the left so as to make the Saturday, Jan. 1, 1910, appear. Since 1910 is not a leap year, February has twenty-eight days and the twenty-eighth is a Monday. The sliding part 2 is then moved to the left so that the day Tuesday appears for Mar. 1, 1910. Note that the year 1910 begins and ends with Saturday, that the parameters are 5,5, and that the left edges of the two sliding parts 1, 2 coincide.

The same operation is repeated for the year 1911.

The following year (1912) is a leap year. It therefore begins with a Monday. February has twenty-nine days and ends with a Thursday. Therefore, the 1st of March is a Friday; note how the sliding part 2 must in this case be shifted two positions. At this point, note that the leap year 1912 begins with Monday and ends with Tuesday, that the parameters are 7,1, and that the left edges of the two sliding parts 1, 2 do not coincide.

To proceed in the calibration operation, note that, coming from the leap year when the operation is finished, the year 1913 will find, on parameters 2,2, that the left edges of the two sliding parts 1,2 again coincide. In fact, the year 1912 has one extra day and so ends on a Tuesday, although it began on a Monday.

The year 1914 is set just as described above for a non-leap year. At the end of the operation, note that the sliding parts 1,2 are positioned on parameters 3,3.

To set the following non-leap year 1915, a Friday must appear on the 1st of January. At this point, the sliding parts 1,2 may be shifted to the right and returned to the initial position 4,4.

The above shows how starting from a non-leap year immediately following a leap year, the sliding parts 1,2 are always returned to the initial position 4,4 after six years, and also how there are a total of seven operating parameters, including the starting year for the calibration.

In fact, continuing to operate with the slide rule-calendar within the limits of the seven parameters, the same position 4,4 will be found again after 11 years. This is repeated in another 11, to then reappear after another six, according to the periodicity 6, 11, 11, 6, 11, 11, 6, within the same century.

In this way, it is clear that all the operating functions following the calibration operations may be effected within the limits of linear shifts between the first and last of the seven parameters discussed above.

Figure 2:
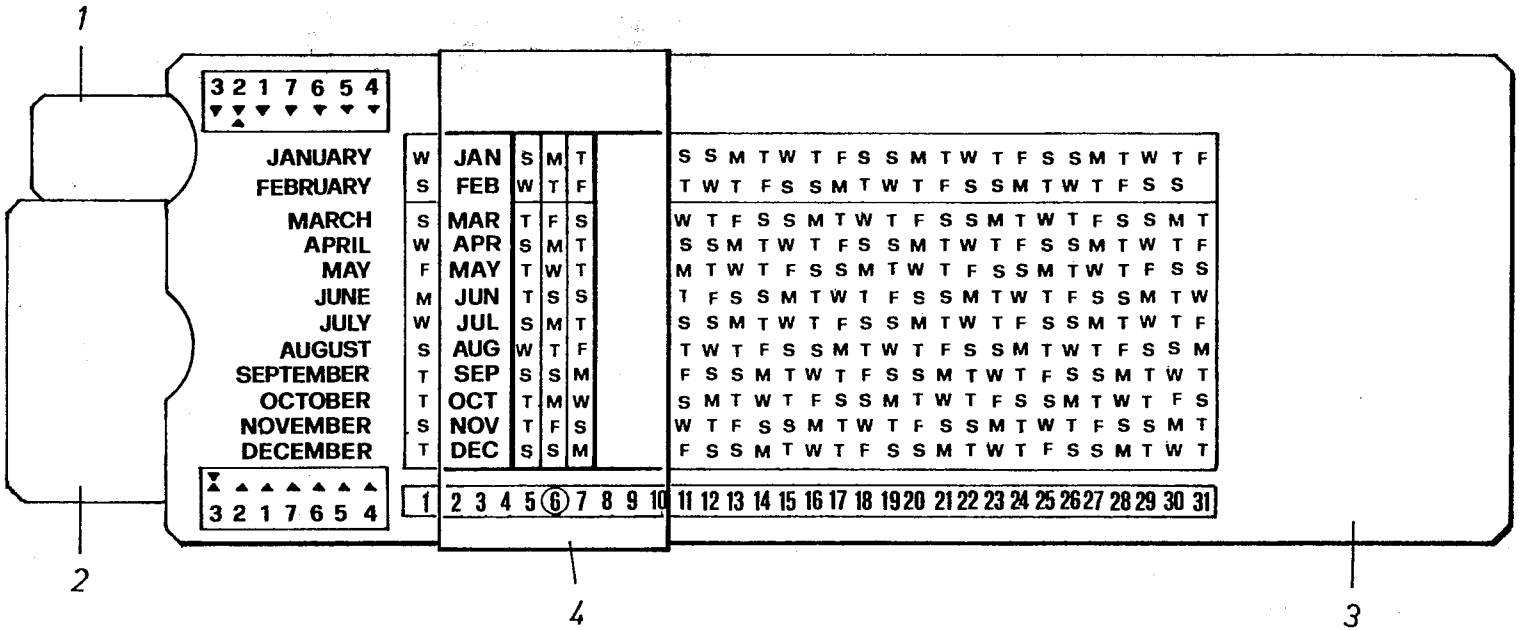
FIG. 2 is a front plan view of the slide rule-calendar of FIG. 1 but set to the 6th day of the year 1908.
Figure 3:
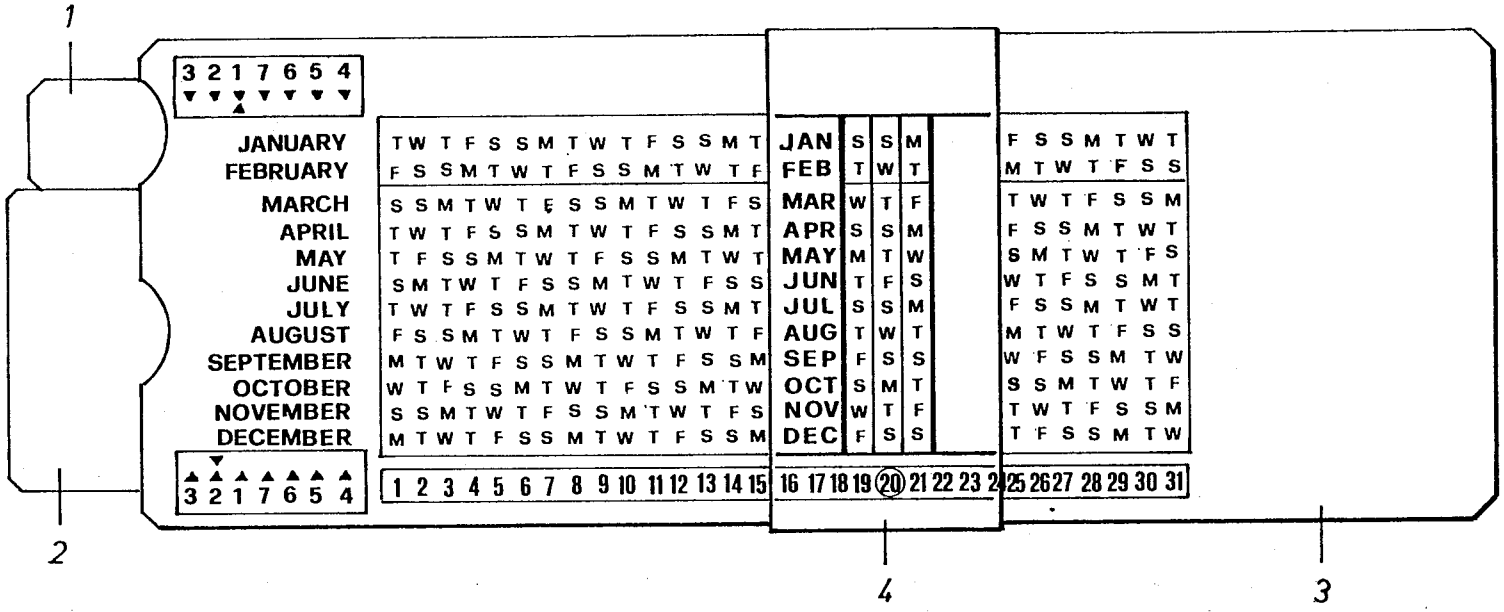
FIG. 3 is a front plan view of the slide rule-calendar of FIG. 1 set to the 20th day of 1980.
Figure 4:
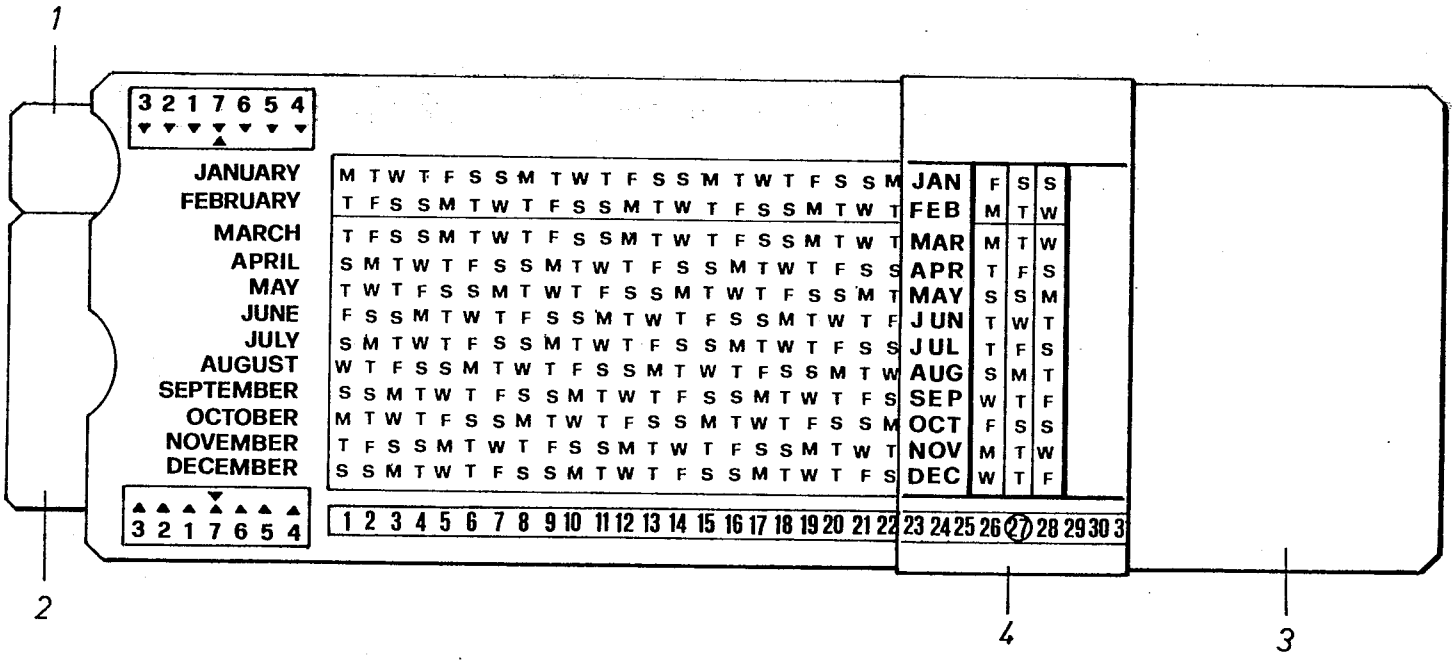
FIG. 4 is a front plan view of the slide rule-calendar of FIG. 1 set to the 27th day of 1990.

FIGS. 2, 3 and 4 show the placement of the sliding parts 1,2 and the cursor 4 on, respectively, the sixth day of 1908, the twentieth day of 1980 and the twenty-seventh day of 1990, corresponding to the respective pairs of parameters 2,3, 1,2 and 7,7. The fact that the two parameters are discordant in the first two cases and are concordant in the last one shows that the former years are leap years while the latter is not. Note that in these figures, rather than an indicator arrow beneath the central vertical window of the cursor, an indicator circle is provided.

Figure 5:
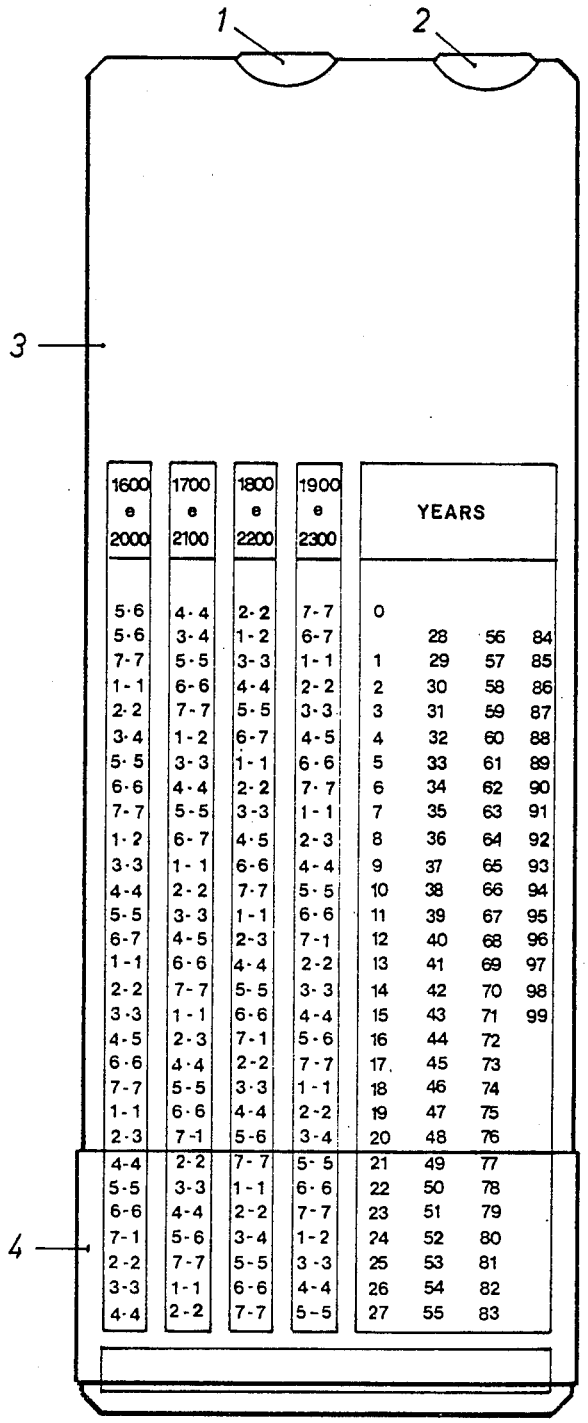
FIG. 5 is a plan view of the back of the slide rule-calendar of FIG. 1.

Finally, FIG. 5 shows the back of the fixed sheath-like part of the slide rule-calendar. As shown in the drawing, the written text gives the four columns for pairs of centuries for which the pairs of parameters are set out. Horizontally from these, the years corresponding to the pairs are set out next to them.

As already mentioned, to set any year desired, the relative pair of parameters is read, and the sliding parts 1,2 are shifted so that the upper and lower arrows correspond respectively to the first and second parameters. At this point, the cursor is simply moved in one direction or another along the solar days given on the bottom of fixed sheath-like part 3 to determine any day of any month of the set year. At the same time, the same day of that month is shown for every other equivalent past or future year.

The object of the invention has been described and illustrated with reference to a preferred embodiment. However, variations in shape, arrangement and proportions are of course possible, as is the application of the same principle of periodic recurrences to other calendars, without going beyond the bounds of this invention.

I claim:

1. An infinite calendar comprising a flat sheath member defining an enclosed space having closed front and rear surfaces, closed top and bottom surfaces, a closed first end, and an open second end; first and second slide members slidably received within the enclosed space and slideable out said open second end and with respect to each other, said first and second slide members being of a length to abut against said closed first end when fully withdrawn within said enclosed space; said first slide member having thereon two rows of indicia correlated respectively to the first two months of the year, said second slide member having thereon rows of indicia correlated respectively to the remaining months of the year, each row of indicia including indicia indicative of the days of the week for a plurality of weeks at least equal to the number of weeks in the correlative month; each of said slide members additionally having an indicator indicium thereon; said sheath member front surface having thereon two sets of seven correlating indicia, one set of correlating indicia adjacent each of said indicator indicia when said slide members are positioned in said enclosed space; said sheath member further having along one edge thereof numerical indicia corresponding to the days of the month and having a transparent window overlying said slide members rows of indicia when said slide members are in said enclosed space to make said rows of indicia visible through said transparent window; a cursor member slidably positioned on said sheath member and having a transparent window overlying said front surface transparent window to make said rows of indicia visible therethrough and a marker adjacent said sheath member one edge; one of said members having thereon a table correlating the years of the Gregorian calendar with a pair of said correlating indicia, one of said pair of said correlating indicia being from the set adjacent the indicator indicium of said first slide member and the other of said pair of said correlating indicia being from the set adjacent the indicator indicium of said second slide member, the pair of correlating indicia correlated with a selected year of the Gregorian calendar being the correlating indicia to be positioned adjacent said indicator indicia to position said first and second slide members such that said rows of indicia align with said numerical indicia to provide a calendar for the selected year with said cursor member slidable to a selected one of said numerical indicia to show through said transparent windows the day of the week for the day of the month corresponding with the selected numerical indicium for each month of the selected year.

* * * * *